US005381385A

United States Patent [19]

Greenstein

[11] Patent Number: 5,381,385

[45] Date of Patent: Jan. 10, 1995

[54] ELECTRICAL INTERCONNECT FOR MULTILAYER TRANSDUCER ELEMENTS OF A TWO-DIMENSIONAL TRANSDUCER ARRAY

[75] Inventor: Michael Greenstein, Los Altos, Calif.

[73] Assignee: Hewlett-Packard Company, Palo Alto, Calif.

[21] Appl. No.: 101,867

[22] Filed: Aug. 4, 1993

[51] Int. Cl.[6] ..... H04R 17/00

[52] U.S. Cl. ..... 367/140; 367/155; 310/334; 310/336; 310/365; 128/662.03

[58] Field of Search ..... 367/140, 153, 155; 310/322, 334, 336, 365; 128/662.03

[56] References Cited

U.S. PATENT DOCUMENTS

| | | | |
|---|---|---|---|
| 4,633,122 | 12/1986 | Radice | 310/339 |
| 4,638,468 | 1/1987 | Francis | 367/153 |
| 4,734,044 | 3/1988 | Radice | 439/78 |
| 4,825,115 | 4/1989 | Kawabe et al. | 310/327 |
| 4,881,212 | 11/1989 | Takeuchi | 367/152 |
| 5,163,436 | 11/1992 | Saitoh et al. | 128/662.03 |

OTHER PUBLICATIONS

Goldberg et al., "Multi-Layer PZT Transducer Arrays for Improved Sensitivity," IEEE Ultrasonics Symposium, 1051-0117/92/0000-0551, pp. 551-554, 1992.

Smith et al., "Two-Dimensional Array Transducers using Hybrid Connection Technology," IEEE Ultrasonics Symposium, 1051-0117/92/0000-0555, pp. 555-558, 1992.

*Primary Examiner*—J. Woodrow Eldred

[57] ABSTRACT

A multilayer two-dimensional array of ultrasonic transducer elements includes four via segments at the four corners of each transducer element. A first pair of diagonally opposed via segments provide signals to signal electrode layers of each transducer element. A second pair of diagonally opposed via segments interconnect ground electrode layers. Thus, a redundant interconnection scheme is achieved. If the transducer elements include piezoelectric layers having a square cross section parallel to a transducer radiating surface, four-fold symmetry is maintained, despite the formation of the four via segments. Also disclosed is a method of forming a two-dimensional array.

14 Claims, 7 Drawing Sheets

ELECTRICAL INTERCONNECT FOR MULTILAYER TRANSDUCER ELEMENTS OF A TWO-DIMENSIONAL TRANSDUCER ARRAY

TECHNICAL FIELD

The present invention relates generally to acoustic transducer devices and more particularly to approaches to achieving electrical connections to individual multilayer transducer elements in a two-dimensional array of elements.

BACKGROUND ART

A diagnostic ultrasonic imaging system for medical use may be utilized to form images of tissues of a human body by electrically exciting an acoustic transducer element or an array of acoustic transducer elements to generate short ultrasonic pulses that are caused to travel into the body. Echoes from the tissues are received by the ultrasonic transducer element or elements and are converted into electrical signals. The electrical signals are amplified and used to form a cross sectional image of the tissues. Echographic examination is also employed outside of the medical field.

A linear array of transducer elements may be used for echographic examinations, but a two-dimensional array is superior in many applications. For example, a two-dimensional array can be focused electronically, so that the array can be fixed in one position during the examination process. Electronic focusing is achieved by delaying signals to selected transducer elements in the array. The phase correction improves resolution.

An area of concern in the fabrication of two-dimensional arrays of transducer elements is the method of achieving electrical interconnections to transducer elements that are not exposed at the sides of the array. U.S. Pat. No. 4,825,115 to Kawabe et al. describes a method of providing excitation energy to a center column of elements. Bonding wires may be attached to center elements, whereafter a backing layer is formed using molding techniques. As noted in the patent, the difficulty with this interconnection scheme is that as the distance between the transducer elements is reduced in order to improve resolution, the potential of two bonding wires shorting together is increased. Kawabe et al. teaches that a preferred interconnection scheme is one that uses L-shaped printed wiring boards having first legs that contact the transducer elements and having second legs that extend rearwardly along the spacing between adjacent columns of elements. The backing layer is molded between the second legs of the L-shaped printed wiring boards. While Kawabe et al. provides a significant improvement over prior interconnection schemes, the first legs of the printed circuit board remain in contact with the transducer elements, so as to provide a surface for reflecting wave energy.

The interconnection scheme becomes even more problematic if each transducer element is comprised of a multilayer lamination of piezoelectric layers. One advantage of the multilayer transducer element is that the electrical impedance of the element can be reduced. The layers can be electrically connected in parallel to reduce the impedance by a factor of the square of the number of layers. However, an increase in the number of layers requires an increase in the number of connections to each transducer element.

An interconnect scheme is described by Goldberg et al. in "Multi-Layer PZT Transducer Arrays for Improved Sensitivity," IEEE Ultrasonics Symposium, 1051-0117/92/0000-0551, pages 551-554, 1992. Each element includes a ground via that is midway along the width of one edge of the element and includes a signal via that is midway along the edge opposite to the ground via. Insulation gaps shield signal vias from ground electrodes and shield ground vias from signal electrodes. The approach taken by Goldberg et al. provides an improvement in the interconnect approach, but the improvement is obtained at a sacrifice of performance. In a general sense, the three-dimensional ultrasonic beam profile, i.e. beam intensity as a function of direction, is a two-dimensional Fourier transform of an element aperture. The hour-glass shaped transducer elements of Goldberg et al. cause the beam intensity to be substantially more asymmetrical than if the transducer elements were to remain in their original square configuration.

An object of the present invention is to provide an approach to electrical interconnections of electrode layers of a multilayer transducer array, wherein ultrasonic beam symmetry is substantially maintained. Another object is to provide a method for forming the two-dimensional transducer array.

SUMMARY OF THE INVENTION

The above objects have been met by an interconnect approach that allows individual transducer elements of a multilayer two-dimensional ultrasonic array to achieve four-fold symmetry and to operate at high frequencies. The four-fold symmetry is achieved by forming via segments at each of four corners of a transducer element having substantially identical sidewalls. While other factors may dictate fabricating transducer elements having unequal sidewalls, e.g., a generally rectangular element, the formation of the via segments at the corners, rather than along sidewalls, provides an increased symmetry that translates into a more symmetrical ultrasonic beam intensity.

Each transducer element in the multilayer two-dimensional array includes a plurality of piezoelectric layers and includes electrode layers at opposed faces of the piezoelectric layers. Two corner via segments connect ground electrode layers, while the remaining two via segments connect signal electrode layers. Excitation signals are impressed across the piezoelectric layers by conducting signals through the via segments.

The multilayer two-dimensional array of transducer elements is fabricated by forming the vias in a stack of piezoelectric layers and electrode layers. In one embodiment, each piezoelectric layer is individually operated upon with at least one of its associated electrode layers in order to obtain the desired via formation through the individual layers. The necessary holes may be formed by laser drilling or by mechanical drilling. An annular insulator is formed for each passage of a signal via through a ground electrode layer and for each passage of a ground via through a signal electrode layer. The layers are then aligned and bonded to form a stack of piezoelectric and electrode layers having vias extending therethrough.

Azimuthal cuts through the piezoelectric stack bisect each one of the vias. Elevation cuts again segment the stack, creating a street-like structure in which a via segment is located at each corner.

An advantage of the present invention is that the corner via segments maintain a symmetry for each transducer element, so that performance of the resulting ultrasonic device is not substantially affected. If each of the transducer elements is square with respect to a cross section that is parallel to a radiating surface, four-fold symmetry is achieved. Another advantage is that diagonally opposed via segments link the same electrode layers, thereby providing a redundant interconnect scheme which may lead to an increase in manufacturing yield. The vias provide a means of reliably interconnecting layers for transducer elements that are closely spaced and are surrounded by other transducer elements.

BEST MODE FOR CARRYING OUT THE INVENTION

Figure 1:
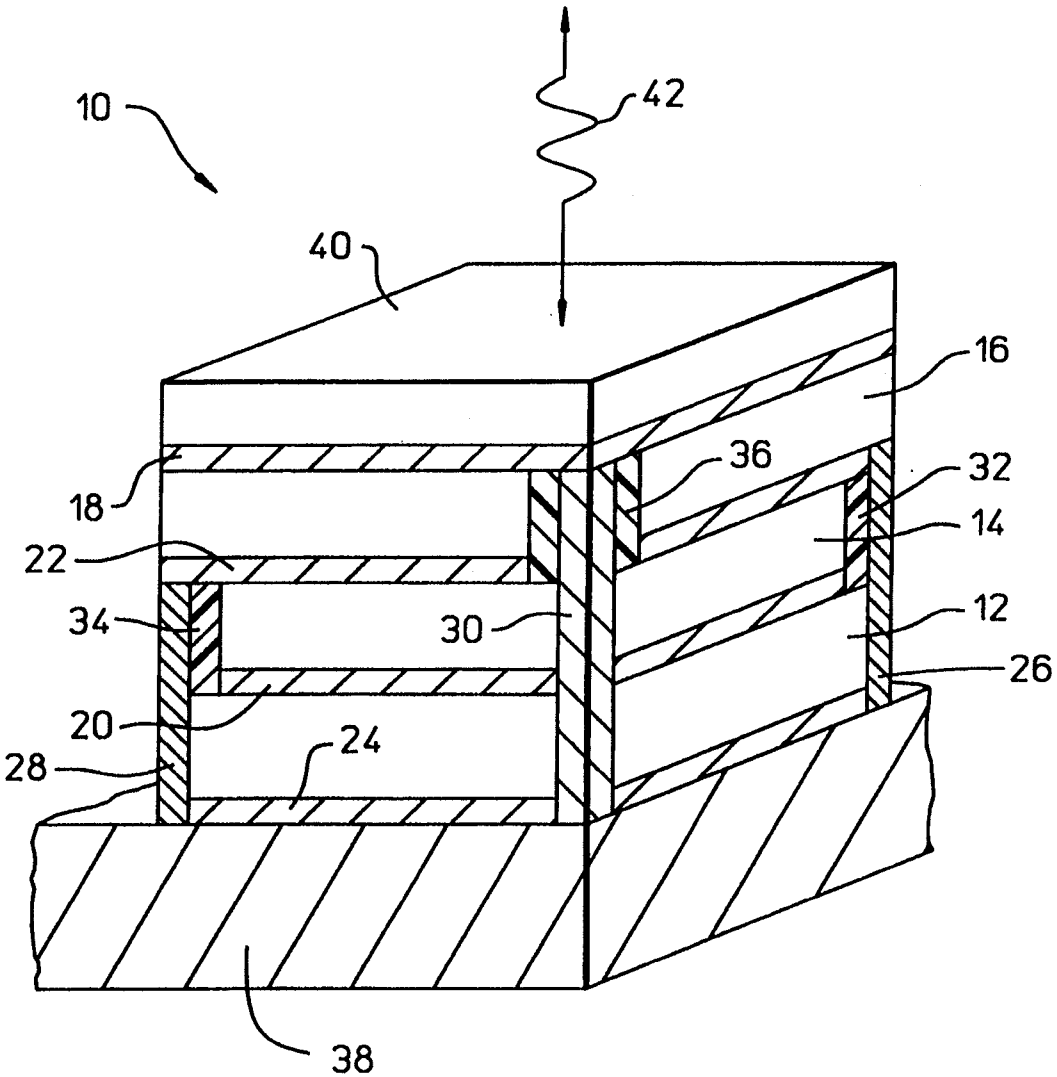
FIG. 1 is a perspective view of a multilayer transducer element having corner via segments in accordance with the present invention.

With reference to FIG. 1, a single transducer element 10 of an array of elements is shown. The transducer element includes a stack of three piezoelectric layers 12, 14 and 16. The piezoelectric layers are equal in thickness and are wired in an electrically parallel arrangement. "Piezoelectric" is defined as the ability to efficiently generate mechanical waves in response to an applied electrical field. Known piezoelectric ceramics and polymers may be used to form the layers 12–16, but PZT has been found to be particularly suitable.

The transducer element 10 includes two ground electrodes 18 and 20 and two signal electrodes 22 and 24, The signal electrodes are electrically interconnected by diagonally opposed signal via segments 26 and 28. FIG. 1 shows a ground via segment 30 electrically linking the two ground electrodes 18 and 20. While not shown, a second ground via segment is located at a corner of the transducer element diagonally opposite to the first ground via segment 30.

The signal via segments 26 and 28 are electrically isolated from the ground electrode 20 by dielectric members 32 and 34. As will be explained more fully below, each via segment 26, 28 and 30 has a sectorial configuration. The dielectric members 32 and 34 follow the curvature of the sectorial via segments. In like manner, a third dielectric member 36 follows the curved side of the via segment 30 to electrically isolate the signal electrode 22 from the ground via segment 30.

The electrodes 18–24 and the via segments 26–30 may be made of the same material. The selected material should be highly conductive and should have a coefficient of thermal expansion close to that of the piezoelectric layers 12, 14 and 16. Moreover, the selected material should be one that can be made into a thick film ink having a high melting point. Organometallic compounds such as platinum and palladium may be utilized.

As previously noted, the dielectric members 32–36 electrically isolate the via segments 26–30 from selected electrodes 20 and 22. The dielectric members also serve to prevent the via segments from applying a potential difference at the vertical sides of the transducer element 10. Suitable dielectric materials include alumina and silica.

In a transmit mode, an excitation signal is applied to the transducer element at the via segments 26–30. A backing layer 38 made of a material that absorbs ultrasonic waves may optionally be employed to minimize reflections from the lower surface of the lowermost piezoelectric layer 12. The backing layer may be a heavy metal, such as tungsten, in a lighter matrix such as a polymer or a ceramic. At the opposite side of the piezoelectric layers 12–16 is a front matching layer 40 for matching the acoustic impedance of the transducer element 10 to the medium into which acoustic waves 42 are to be transmitted and received. A suitable material for the front matching layer depends upon the medium into which the waves are to be transmitted.

In a receive mode, reflected waves are received at the front matching layer 40 and travel through the piezoelectric layers 12–16. Mechanical stresses at the piezoelectric layers generate corresponding electrical charges at the electrodes 18–24.

Figure 2:
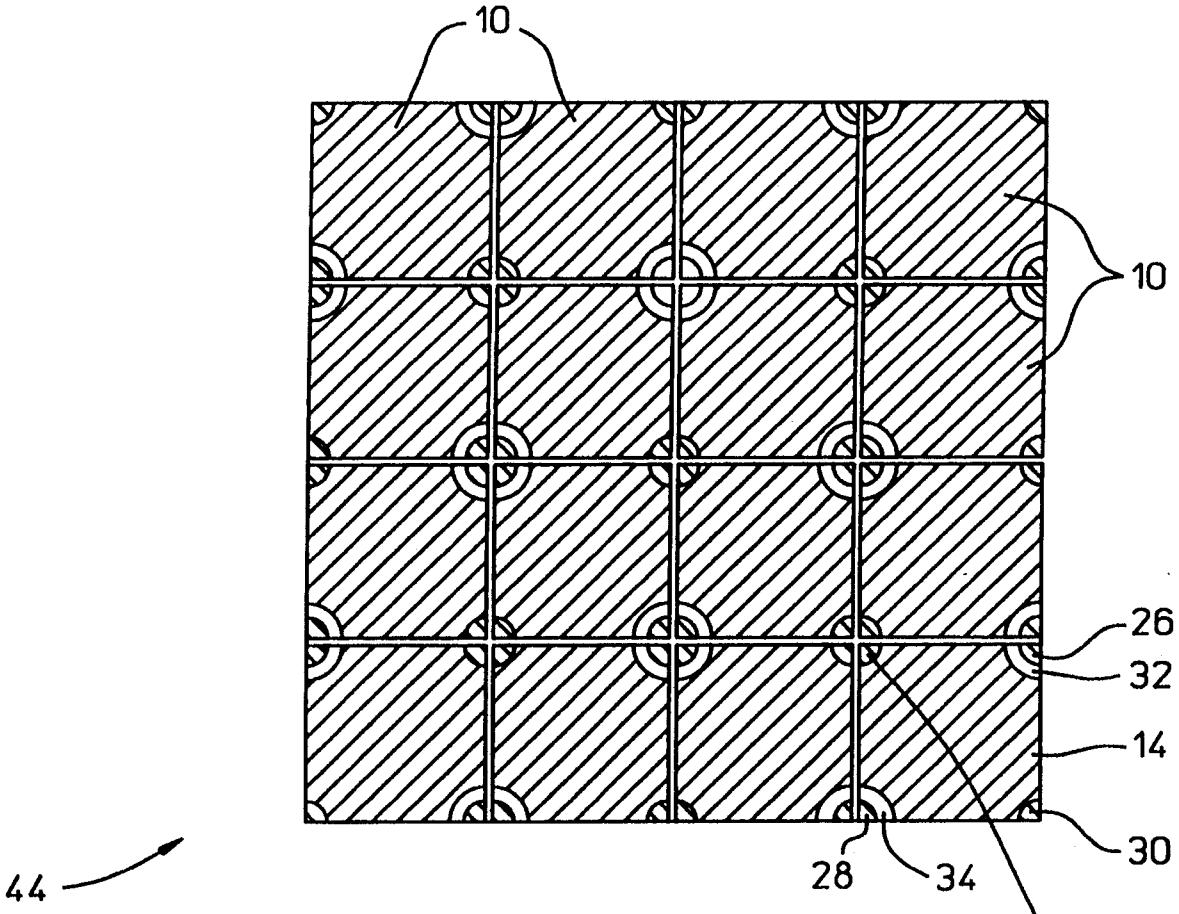
FIG. 2 is a top sectional view of a multilayer two-dimensional array of transducer elements of FIG. 1.

FIG. 2 is a top sectional view through a two-dimensional array 44 of transducer elements 10, wherein the sectional view is through the center piezoelectric layer 14 of FIG. 1. The transducer element of FIG. 1 is shown in the lower right corner of the array 44 of FIG. 2. Sectorial via segments 26 and 28 are electrically isolated from a piezoelectric layer 14 by the dielectric members 32 and 34. Ground via segments 30 and 46 extend through the piezoelectric layer to electrically link ground electrodes, not shown. Each of the sixteen transducer elements 10 includes a center piezoelectric layer that has diagonally opposed ground via segments and diagonally opposed signal via segments that are shielded by dielectric members. Optionally, the electrical arrangement of piezoelectric layers may vary from one transducer element 10 to the next transducer element. For example, the transducer element 10 of FIG. 1 may be adjacent to a transducer element having a stack of piezoelectric layers that are electrically connected in series. More likely, it is possible that the adjacent transducer elements are electrically equivalent, but the electrodes alternate in electrical connection. That is, the electrode of one transducer element may be a ground electrode, while the positionally equivalent electrode of an adjacent element is a signal electrode. In either case, the positions of the dielectric members 32 and 34 may vary from one transducer element to the next.

Figure 3:
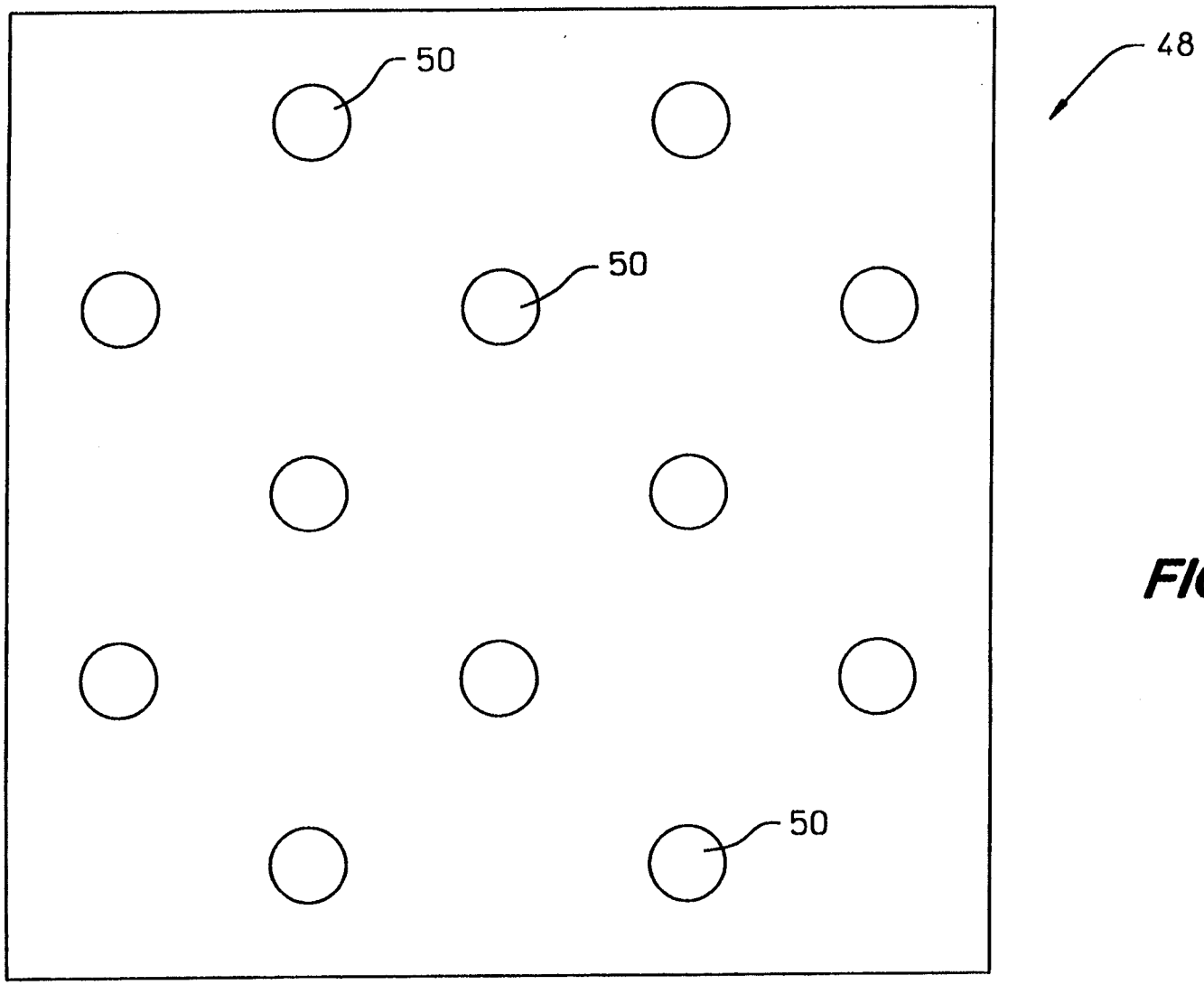
FIGS. 3–7 are top views of fabrication steps for forming the array of FIG. 2.

The steps of forming the two-dimensional array 44 of transducer elements 10 of FIG. 2 is shown in FIGS. 3–7. In FIG. 3, a single piezoelectric layer is formed using conventional techniques. For example, a PZT slurry may be used to form a thin sheet that is commonly referred to as a "green ceramic" or "green sheet." A palladium or platinum electrode layer is then formed on the green sheet. The layer of FIG. 3 is larger in both width and length than the structure of FIG. 2 in order to facilitate formation of the vias.

Twelve holes 50 are drilled into the piezoelectric layer 48 in positions corresponding to the locations of signal vias that will be formed. The diameter of the holes 50 determines the outside diameter of annular insulators that will form the dielectric members.

Figure 4:
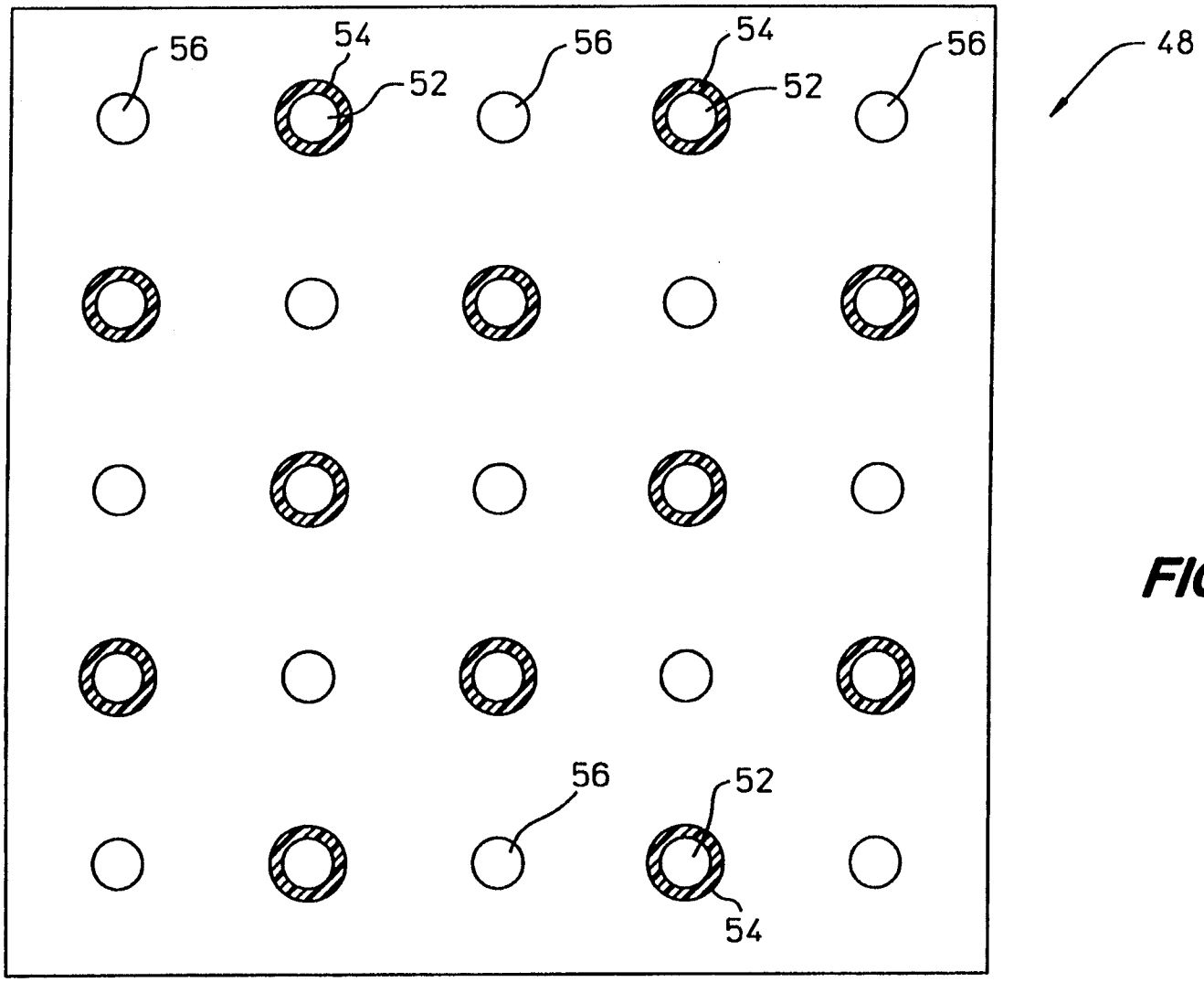

In FIG. 4, the twelve holes have been filled with a dielectric, such as an alumina-based material or a silica-based material. Smaller holes 52 are then drilled in each of the dielectric-filled holes to form annular insulators 54. The diameter of the holes 52 determines the diameter of the signal vias to be formed. Thirteen holes 56 that are equal to the diameter of the holes 52 are drilled in positions corresponding to the desired locations of signal vias. The large diameter holes 50 of FIG. 3 and the smaller diameter holes 52 and 56 of FIG. 4 may be formed by laser-drilling techniques. Alternatively, mechanical drilling may be utilized.

Figure 5:
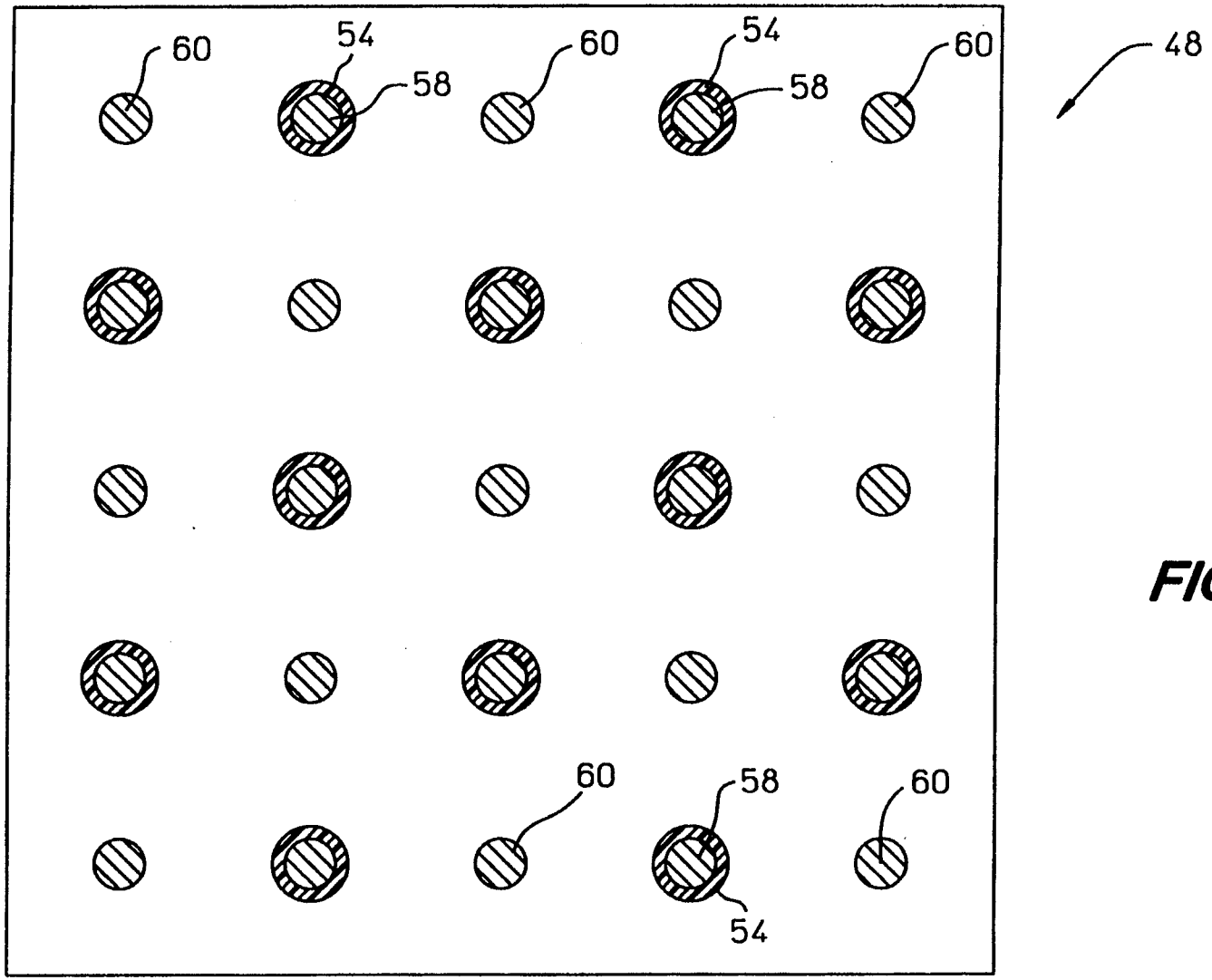

In FIG. 5, conductive material has been deposited to form the signal vias 58 and ground vias 60. The number of vias ($N_{VIAS}$) is directly related to the number of transducer elements ($N_{ELEMENTS}$) in a row of an N×N array by the formula $N_{VIAS}=(N_{ELEMENTS}+1)^2$. Thus, for the embodiment of FIG. 2 in which $N_{LAYERS}=4$, $N_{VIAS}=(4+1)^2=25$. A more typical array may be one in which there are 50×50 elements. In comparison to the present invention, if the array were limited to a single ground via segment and a single signal via segment for each element, there would be a requirement of a total number of vias equal to $(N_{ELEMENTS}+1)\times N_{ELEMENTS}=2{,}550$. On the other hand, the four-via segment arrangement of FIG. 2 would require 2,601 vias to be drilled, an increase of only 51 vias. One advantage of the present invention is that the small increase in the number of vias still results in a doubling of the connections of each transducer element to signal transmitting and receiving circuitry. The diagonally opposed via segments of each transducer element achieve a redundancy of interconnections.

Figure 6:
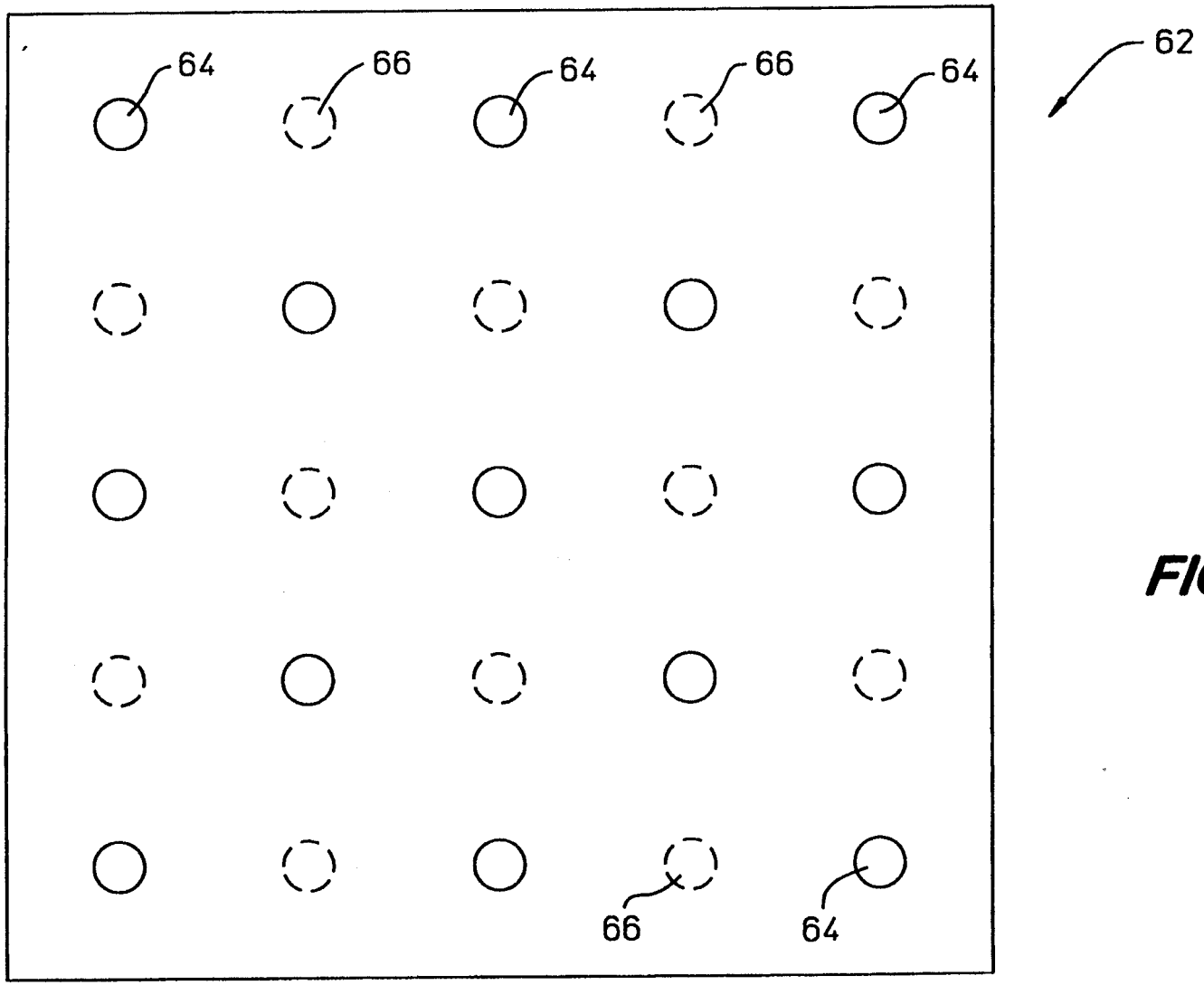

The piezoelectric layer 48 of FIG. 5 is then bonded to other piezoelectric layers having corresponding signal vias 58 and ground vias 60. Each even-numbered layer has annular insulators 54 encircling the signal vias 58. If the number of layers exceeds three, each odd-numbered layer other than the first and last layer will have an annular insulator encircling the ground vias 60, rather than the signal vias 58. As shown in FIG. 1, the first piezoelectric layer 12 does not include ground via segments and the last piezoelectric layer 16 does not include signal via segments. Therefore, in drilling holes through the green sheets that will become the first and last piezoelectric layers, only a portion of the holes need to be drilled. In FIG. 6, a green sheet 62 includes thirteen holes 64, shown in solid. These holes represent the vias through the last piezoelectric layer 16. Not shown are the annular insulators encircling the holes 64 which will become the ground via segments. FIG. 6 includes phantom holes 66 representing signal vias that would be drilled through a green sheet for forming the first piezoelectric layer 12 of FIG. 1.

Figure 7:
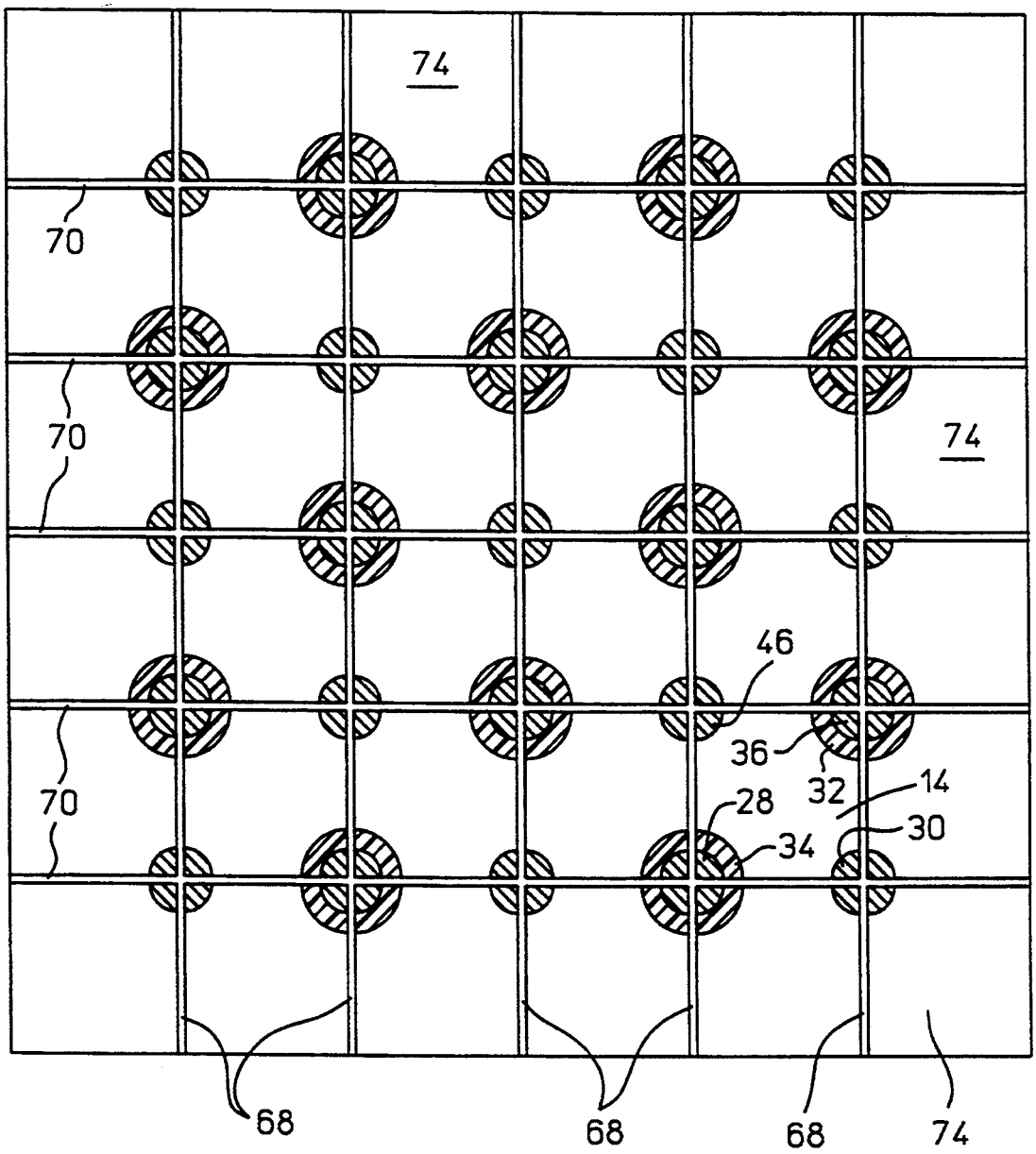

After the separately processed green sheets have been laminated to form a transducer stack, the stack is fired using well known techniques. The stack may then be bonded to the backing layer 38 of FIG. 1. Referring now to FIG. 7, a series of elevation directed cuts 68 are formed through the elevation stack to bisect each signal via and each ground via. Azimuthal directed cuts 70 also intersect each signal via and each ground via to form the signal via segments 26 and 28 and the ground via segments 30 and 46 described above. Optionally, the cuts 68 and 70 extend partially into the backing layer supporting the stack.

The two-dimensional transducer array 72 of FIG. 7 includes twenty inactive elements 74 surrounding a 4×4 array of active transducer elements. The inactive elements 74 may be used for handling and mounting the array 72. Optionally, the inactive elements are removed to form the structure shown in FIG. 2.

While the above-described fabrication method is considered to be the preferred embodiment, modifications can be made. For example, the conductive material that forms the signal vias and ground vias may be deposited only after the green sheets have been aligned and bonded to form the transducer stack. However, this would require the upper piezoelectric layer to include both signal vias and ground vias, rather than only the ground vias as shown in the embodiment of FIG. 1.

I claim:

1. An ultrasonic transducer element comprising:

a stack of piezoelectric layers, said stack having a first pair of sidewalls which extend along intersecting planes that are perpendicular to said piezoelectric layers;

electrode means for impressing an excitation signal across said piezoelectric layers; and an electrically conductive via segment disposed at the intersection of said planes, said via segment thereby forming a corner of said stack, said via segment being in electrical communication with said electrode means.

2. The ultrasonic transducer element of claim 1 wherein said electrode means includes electrically conductive layers disposed between said piezoelectric layers, said via segment being connected to selected ones of said electrically conductive layers.

3. The ultrasonic transducer element of claim 1 wherein said stack includes a second pair of sidewalls which extend along intersecting planes, said transducer element further comprising an electrically conductive second via segment at the intersection of said planes along which said second pair of sidewalls extend, said second via segment being in electrical communication with said electrode means.

4. The ultrasonic transducer element of claim 1 wherein said via segment is wedge-shaped in a cross section that is parallel to said piezoelectric layers.

5. The ultrasonic transducer element of claim 1 wherein said stack of piezoelectric layers is a parallelepiped, and wherein said via segment is one of four via segments which extend in parallel relationship along corners of said parallelepiped.

6. The ultrasonic transducer element of claim 5 wherein said electrode means includes conductive layers between adjacent piezoelectric layers of said stack, said conductive layers including signal layers and ground layers, two of said four via segments being electrically connected to said ground layers and two of said four via segments being electrically connected to said signal layers.

7. The ultrasonic transducer element of claim 1 wherein said stack is one stack in a two-dimensional array of stacks of piezoelectric layers, thereby forming a two-dimensional array of transducer elements, each stack having at least one via segment at a corner of said stack.

8. The ultrasonic transducer element of claim 7 wherein each stack has four corner via segments and each corner via segment has two linear walls and an arcuate wall, With said two linear walls having intersecting first ends and having second ends that are connected to opposite ends of said arcuate wall.

9. A transducer device comprising:

a two-dimensional array of transducer elements, each transducer element having a plurality of piezoelectric layers and a plurality of electrode layers at opposed faces of said piezoelectric layers to impress an excitation signal across said piezoelectric layers, said transducer elements having four sidewalls extending to corner regions; and four via segments disposed along said corner regions, including a first via segment electrically coupled to a first set of said electrode layers and further including a second via segment electrically coupled to a second set of said electrode layers.

10. The device of claim 9 wherein said four via segments include a third via segment electrically coupled to said first set of electrode layers and include a fourth via segment electrically coupled to said second set of electrode layers.

11. The device of claim 9 wherein each of said four via segments has two linear exterior walls and an arcuate interior wall connected to said linear exterior walls.

12. The device of claim 9 wherein each of said sidewalls of said transducer elements are substantially identical.

13. The device of claim 9 wherein said set of electrode layers is signal layers and said second set of electrode layers is ground layers.

14. The device of claim 9 wherein said transducer elements are ultrasonic transducer elements.

* * * * *